United States Patent [19]

Thow et al.

[11] Patent Number: 5,069,200

[45] Date of Patent: Dec. 3, 1991

[54] GAS-FIRED ARTIFICIAL LOG ASSEMBLY

[75] Inventors: Ian Thow, Merseyside, England; Ajay K. Gupta, Cincinnati, Ohio

[73] Assignee: Valor Incorporated, Herderserville, Tenn.

[21] Appl. No.: 661,887

[22] Filed: Feb. 27, 1991

[51] Int. Cl.[5] ..... F24C 3/00

[52] U.S. Cl. ..... 126/512; 126/92 AC; 431/125

[58] Field of Search ..... 126/512, 513, 500, 92 R, 126/92 AC, 92 B, 152 B; 431/125, 110, 112, 328, 329; 40/428

[56] References Cited

U.S. PATENT DOCUMENTS

| | | | |
|---|---|---|---|
| 819,260 | 5/1906 | Whitney | 126/92 R |
| 1,017,751 | 2/1912 | Hansen | 431/125 |
| 2,302,796 | 11/1942 | Oyster . | |
| 2,671,440 | 3/1954 | Dupler | 126/512 |
| 3,042,109 | 7/1962 | Peterson | 431/125 |
| 3,277,882 | 10/1966 | Rose | 126/512 |
| 3,696,801 | 10/1972 | Whitehead | 431/125 |
| 3,760,790 | 9/1973 | Voges et al. | 431/125 |
| 4,258,693 | 3/1981 | Baker | 126/67 |
| 4,271,815 | 6/1981 | Johnson | 126/517 |
| 4,542,735 | 9/1985 | Smith et al. | 126/92 AC |
| 4,573,446 | 3/1986 | Rosiek et al. | 126/92 R |
| 4,573,905 | 3/1986 | Meyers | 126/92 R |
| 4,602,609 | 7/1986 | Wright | 126/92 AC |
| 4,726,351 | 2/1988 | Whittaker et al. | 126/512 |
| 4,793,322 | 12/1988 | Shimek et al. | 126/512 |
| 4,828,485 | 5/1989 | Jankowski | 126/92 R |
| 4,883,043 | 11/1989 | Thow et al. | 431/125 |
| 4,971,030 | 11/1990 | Thow et al. | 126/512 |
| 4,976,253 | 12/1990 | Beal et al. | 126/512 |
| 5,000,162 | 3/1991 | Shimek | 126/512 |

FOREIGN PATENT DOCUMENTS

| | | |
|---|---|---|
| 532097 | 1/1941 | United Kingdom . |
| 2133530 | 7/1984 | United Kingdom . |
| 2135047 | 8/1984 | United Kingdom . |
| 2169700 | 7/1986 | United Kingdom . |
| 2177490 | 1/1987 | United Kingdom . |
| 2185100 | 7/1987 | United Kingdom . |
| 2193569 | 2/1988 | United Kingdom . |

*Primary Examiner*—James C. Yeung

*Attorney, Agent, or Firm*—Wood, Herron & Evans

[57] ABSTRACT

The present invention relates to a gas-fired artificial log assembly for use in fireplaces or stoves, and more particularly to an improved gas-fired artificial log assembly which visually simulates, in a realistic fashion, a fire in a fireplace or stove stacked with generally horizontally disposed artifical logs, and which at the same time supplies substantial space heat to the surrounding room environment.

17 Claims, 3 Drawing Sheets

GAS-FIRED ARTIFICIAL LOG ASSEMBLY

FIELD OF THE INVENTION

The present invention relates to a gas-fired artificial log assembly, and more particularly to an improved artificial log assembly which visually simulates, in a realistic fashion, a fire in a fire-place or stove stacked with generally horizontally disposed artificial logs, which at the same time supplies substantial heat to the surrounding room environment while producing minimal undesirable combustion by-products.

BACKGROUND OF THE INVENTION

Fuel burning fireplaces and stoves are very popular and desirable in houses and apartments, both for heating as well as for aesthetics. There are two primary types of fuel burning fireplaces and stoves — those in which solid fuels such as wood, coal, coke, peat or combinations thereof are burned, and those which burn gas and have simulated solid fuel elements, such as artificial logs, to add an element of realism. Gas-fires in stoves and fireplaces have the advantage that they do not require manual refueling or clearing of ashes and they are very controllable. Because of the advantages of gas-fires, considerable efforts have been made to recreate the appearance of traditional solid fuel fires.

Simulated solid fuel gas-fires for fire-places, that is, those having artificial solid fuel elements such as logs, are known. In general, these consist of a simulated fuel bed which is heated to incandescence by flames, or by the product of combustion of flames, to simulate the visible glowing embers of a solid fuel fire. A principle feature in the aesthetic appeal of real, or traditional, solid fuel fires is the existence of visually perceptible, luminous flames flickering about the main fuel bed. Such flames can be closely mimicked in simulated solid fuel gas-fires by burning neat gas, i.e., gas with little or no primary aeration, which produces a yellow flame. Simulated solid fuel gas-fires which incorporate this feature in combination with an incandescent or glowing bed are known. Such neat gas flames, like those produced in real or traditional solid fuel fires, are not static or spatially fixed, but move or waver about irregularly or randomly due to the air flow in the fireplace.

U S. Pat. No. 4,602,609, discloses a simulated solid fuel fireplace having a main heater burner and a plurality of flame effect burners. The flame effect burners burn neat gas (non-aerated) to produce yellow flames, while the heater burner burns a gas-air mixture with a higher air content to produce very hot "blue" flames for space heating purposes. U.S. Pat. No. 4,573,446 also discloses a simulated solid fuel fire which has a neat gas burner for producing visible yellow flames and a main burner for producing blue heat flames.

One drawback common to various known assemblies of this type is the generally incomplete combustion of the neat gas burned in neat gas burners due to the low air-to-gas ratio in the burners. As a result of the incomplete combustion, carbon monoxide and soot are produced as by-products of the flames. For safety reasons, it is desirable to minimize the production of carbon monoxide and soot.

The shortcomings in the prior art gas fireplace and stove assemblies were addressed in U.S. Pat. Nos. 4,883,043 and 4,971,030, both issued to the inventors named herein. These prior patents are directed to gas-fired artificial log fireplace and stove assemblies, respectively, which are designed to visually simulate, in a realistic fashion, a fire in either a fireplace or a stove, and which supply substantial heat to the surrounding room environment. The present invention further improves upon the prior art assemblies to provide a very realistic-looking simulated solid fuel fire and provides substantial heat to the surrounding room environment while producing minimal undesirable combustion by-products.

SUMMARY OF THE INVENTION

A preferred embodiment of the improved gas-fired artificial log assembly of the present invention includes a support structure having a support plate and a grate-like portion. The support plate supports a base plate of a refractory material that glows visibly when heated above about 1470° F. The assembly further includes first and second front artificial log members which are supported by the base plate and retained by the grate portion. Preferably, the first artificial log member extends about one-half the width of the support structure and is designed and constructed to provide the appearance of a partially burned log. The second front artificial log member extends substantially the entire width of the support structure and has one of its end sections supported by the base plate and its other end section supported by the first artificial log member. The middle or medial section of this second front artificial log member is spaced above the base plate and a channel is thereby defined by the base plate, the medial section of the second front artificial log member and the first front artificial log member. Alternatively, there may be a single front artificial log having a medial channel therethrough. The preferred embodiment further includes a rear artificial log which is spaced from the first and second front artificial log members, extends substantially the entire width of the support structure, and is supported thereby.

A primary gas burner is supported by the support structure and extends along and in front of the first and second front artificial log members (or in the alternative, one single front artificial log member) and the channel, thereby defining a combustion zone. The primary gas burner directs "blue" flame jets generally rearwardly against the base plate, the first and second front artificial log members and into the channel. These flames heat to a visible glow (which is above about 1470° F.) at least portions of the base plate and the first and second front artificial log members. Additionally, since the flame passes into and through the channel, it heats portions of the rear log to a visible glow. Furthermore, substantial heat is radiated to the surroundings and an appearance of glowing logs and underlying embers is provided to enhance the aesthetics of the artificial log fire-place.

In the space between the rear artificial log and the first and second front artificial log members there is disposed neat gas burners for issuing flame jets generally upwardly to enhance the realism of the artificial log assembly. These neat gas burners, which are ignited by the flame from the primary gas burner that passes into and through the channel, are designed to provide realistic-looking "peaked" flames. That is, flames which taper upwardly to a peak at the center thereof.

In certain circumstances, the artificial log assembly of the present invention may be used in unvented fireplaces or stoves. Since the emissions standards are very stringent for such unvented appliances, it is necessary to provide improved combustion efficiency so as to minimize the production of undesirable combustion by-products. This improved combustion efficiency may be aided by providing an elongated plate supported by the grate portion of the support structure generally vertically adjacent the primary gas burner and spaced from the first and second front artificial log members so as to further define the combustion zone. The metal strip serves the dual functions of preventing air that enters through the front of the stove or fireplace from disrupting or otherwise adversely affecting combustion in the combustion zone. Furthermore, the strip aids in retaining the heat from the flames issuing from the primary gas burner so that the combustion zone runs hotter and more efficiently, thereby resulting in the production of less undesirable combustion by-products.

Other specific features of the artificial log assembly of the present invention are contemplated which add to the realistic simulation of a real solid fuel fire and aid in the combustion efficiency. These include providing the second front log member with a truncated branch segment extending outwardly from the medial region of the second front log member adjacent the channel to aid in trapping heat in the combustion zone and channeling the flame from the primary gas burner into the channel. Additionally, a plurality of ember-simulating members may be placed in and around the channel adjacent the first front artificial log member to provide the appearance of burning embers when heated to a visible glow by the flame from the primary gas burner.

DETAILED DESCRIPTION OF THE INVENTION

Figure 1:
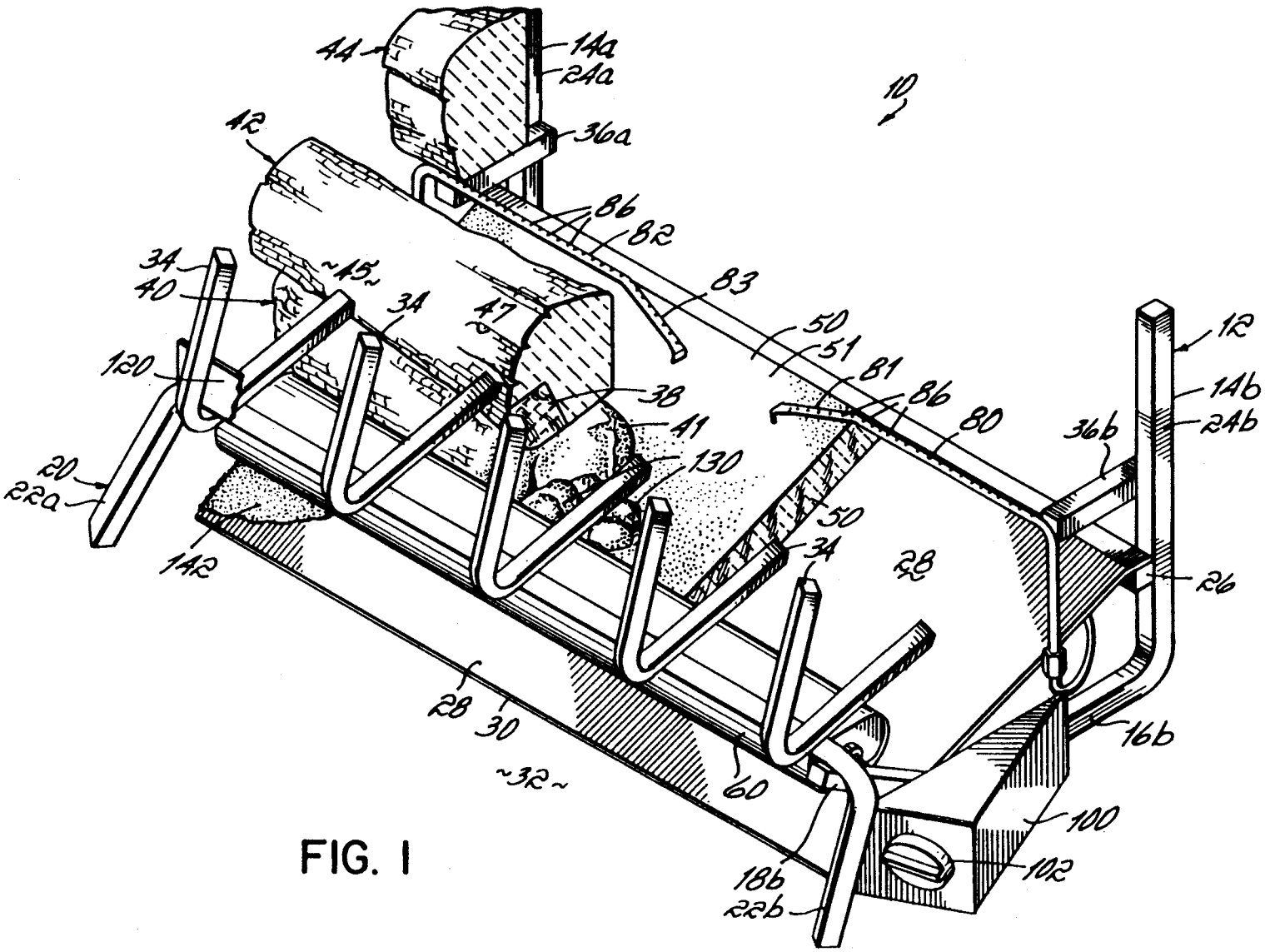
FIG. 1 is a perspective view of one embodiment of the artificial log assembly of this invention, with the logs partially broken away.
Figure 2:
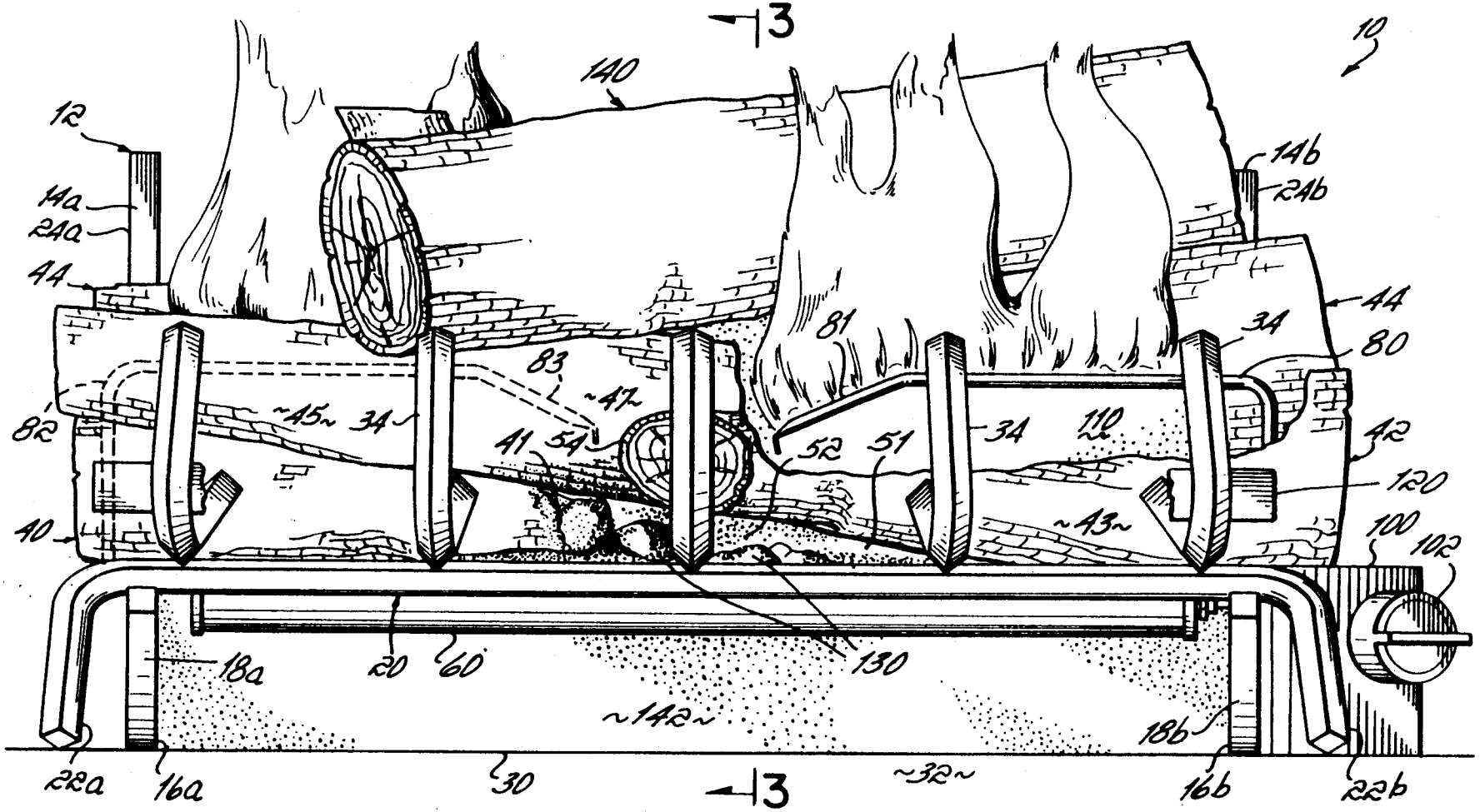
FIG. 2 is a front elevation, partially broken away, of the artificial log assembly of FIG. 1.
Figure 3:
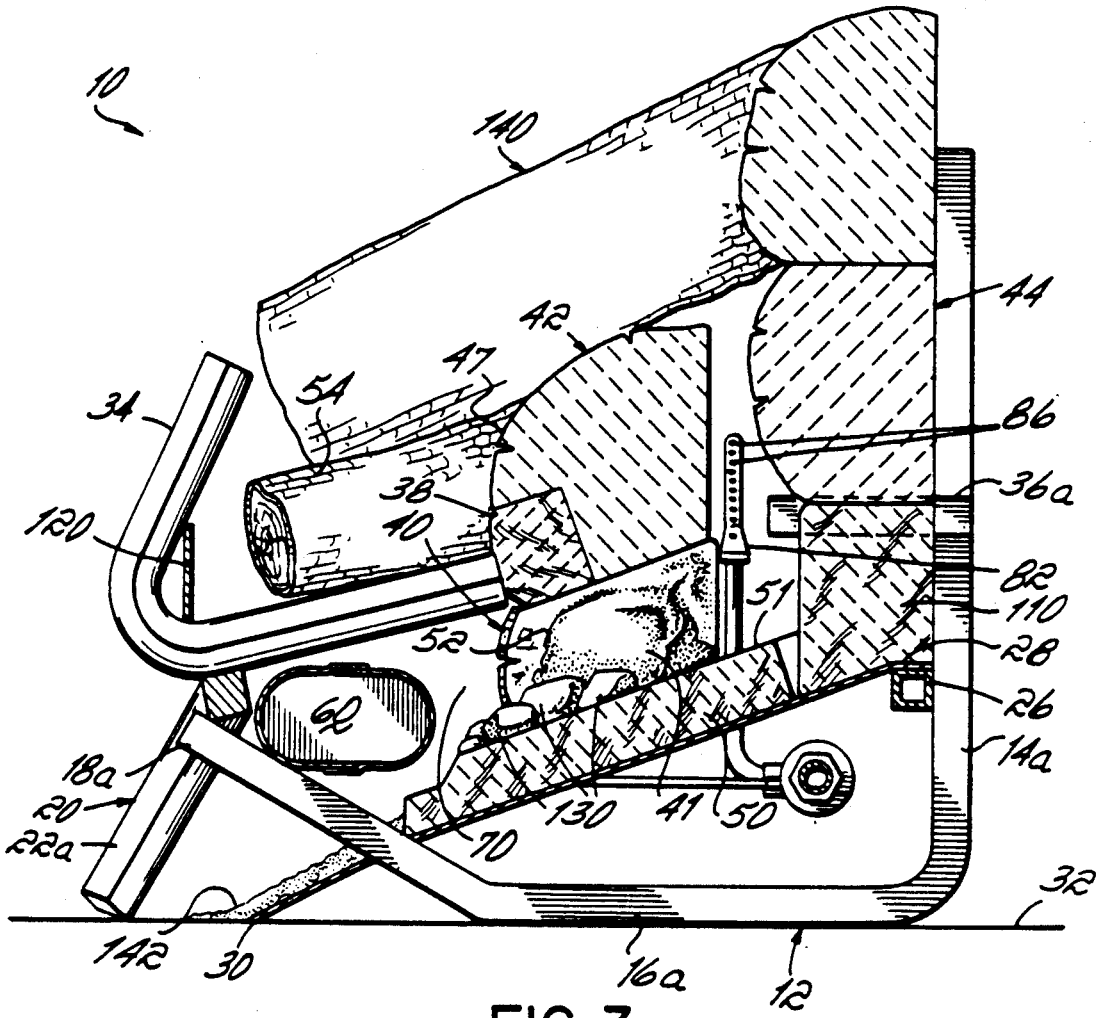
FIG. 3 is a vertical cross-section, from front to back, of the artificial log assembly of the present invention taken on line 3—3 of FIG. 2.

In a preferred embodiment of the present invention shown in FIGS. 1–3, artificial log assembly 10 includes a support structure 12 consisting of a plurality of metal bars generally of rectangular cross-section welded or otherwise secured together to form support structure 12. Support structure 12 may be constructed in a wide variety of suitable configurations, although the configuration shown in the Figures is a preferred embodiment.

As shown, support structure 12 includes first and second generally L-shaped members 14*a* and *b*, respectively. The leg portions 16*a* and 16*b* of L-shaped members 14*a* and 14*b* preferably angle upwardly at their distal ends thus providing angled segments 18*a* and 18*b*. Support structure 12 further includes front leg member 20, which is an elongated bar having down-turned ends 22*a* and 22*b* that serve to support and stabilize structure 12. Front leg member 20 is secured to angled segments 18*a* and 18*b* of L-shaped members 14*a* and 14*b* to provide a free-standing support framework. Upstanding vertical segments 24*a* and 24*b* of L-shaped members 14*a* and 14*b* are interconnected by horizontal support bar 26. Support bar 26 supports the rear edge of support plate 28. Support plate 28 preferably angles downwardly from support bar 26 and its front edge 30 rests on the underlying surface 32 which supports the entire artificial log assembly 10.

Support structure 12 is preferably further provided with a plurality of individual generally L-shaped members 34 which are secured to front leg member 20 and which serve the dual purposes of retaining first and second front artificial log members 40 and 42 in place and also give the appearance of a grate typically found in a real solid fuel fireplace. Finally, support structure 12 includes support members 36*a* and 36*b* which are secured to upstanding vertical segments 24*a* and 24*b* of L-shaped members 14*a* and 14*b*. As shown in FIG. 1, support members 36*a* and 36*b* support respective distal ends of rear log 44, which is spaced rearwardly and upwardly of first and second front artificial log members 40 and 42, to give the appearance of stacked logs.

The artificial log members used in the gas-fired artificial log assembly of the present invention preferably are composite logs of the type disclosed in U.S. patent application Ser. No. 07/661,868, filed on even date herewith naming Ian Thow as inventor, which application is a continuation-in-part of U.S. patent application Ser. No. 07/443,109, filed Nov. 28, 1989, now U.S. Pat. No. 5,026,579, issued June 25, 1991. The specifications of both these applications are hereby incorporated herein by reference. Thus, the artificial logs are preferably of the composite type having a ceramic concrete section of relatively high thermal conductivity for radiating substantial heat to the surroundings when heated and another section of ceramic fiber material having a relatively low conductivity which glows visibly when heated above about 1470° F. The ceramic fiber sections may be in the form of inserts 38 which are either molded into the ceramic concrete section, fitted into cavities provided in the ceramic concrete section, or otherwise attached to the ceramic concrete section, as shown for example in FIGS. 1 and 3. Alternatively, the composite artificial logs may comprise an upper ceramic concrete section and a lower ceramic fiber section attached thereto. In any case, the ceramic fiber sections have at least one surface outwardly exposed in the gas-fired artificial log assembly so as to provide the glowing appearance of a burning natural log when heated above about 1470° F.

Support plate 28, which may be aluminized steel or which may be polished stainless steel to reflect the glow of the flames, preferably supports a base plate 50 composed of a refractory material (e.g., ceramic fiber) that glows visibly above about 1470° F. In a preferred embodiment, first front artificial log member 40 is supported by base plate 50. As shown in FIGS. 2 and 3, first artificial log member 40 is preferably constructed to give the appearance of approximately one-half of a log which has been burned and tapers to a simulated burnt end 41.

Again with reference to FIG. 2, second front artificial log member 42 generally consists of a first distal end section 43, a second distal end section 45 and a medial section 47. The first distal end section 43 is supported by base plate 50 and the second distal end section 45 is supported by first front artificial log member 40. Thus, as shown in FIG. 2, with this arrangement the medial section 47 along with the upper surface 51 of base plate 50 and the burnt end section 41 of first front artificial log member 40 define a channel 52. Second artificial log member 42 preferably also includes a truncated branch portion 54 extending outwardly from the medial section 47 thereof vertically adjacent channel 52.

Figure 4:
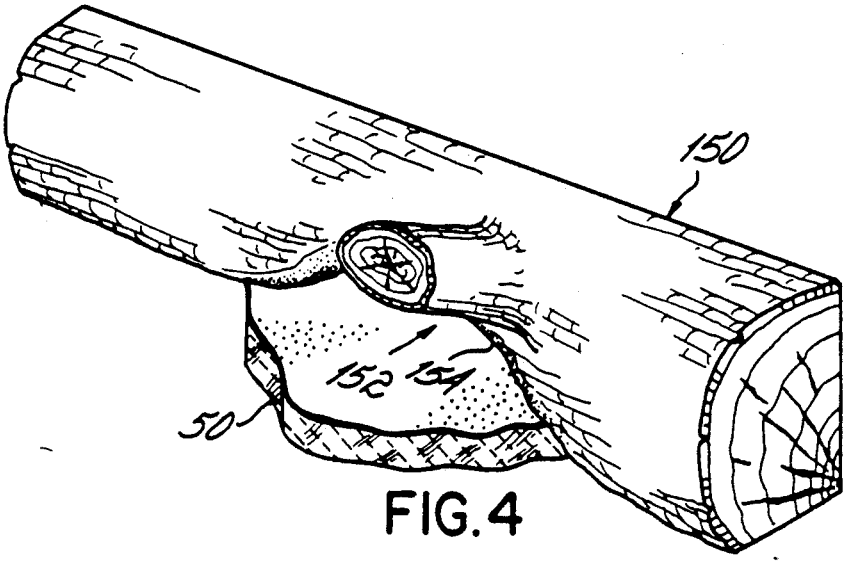
FIG. 4 is a perspective view of an alternative embodiment of a front artificial log member used in the log assembly of the present invention, shown with the base plate partially broken away.

In an alternative embodiment shown in FIG. 4 artificial log assembly 10 may have a single front artificial log that has a structure substantially the same as that defined by first and second front artificial log members 40 and 42 shown, as though those members were bonded together to form an integral log member 150. In this embodiment, as in the dual front log embodiment described hereinabove, the key is the provision of a medial or central channel 152, which allows the flame from the main burner 60, described below, to pass therethrough, while at the same time causing the segments of the front artificial log member(s) on either side of that channel to glow visibly upon heating above about 1470° F. When assembled, the channel 152 is defined by the base plate 50 and the cavity 154 of the front artificial log member 150.

Artificial log assembly 10 further includes main burner 60, which is generally supported by support structure 12, as for example by brackets (not shown) attached to both the burner 12 and the base plate 38, and is spaced in front of first and second front artificial log members 40 and 42, thereby defining a combustion zone 70 therebetween (FIG. 3). Primary gas burner 60 produces hot "blue" flames that are directed generally horizontally rearwardly against base plate 50 and first and second front artificial log members 40 and 42, thereby also passing into and through channel 52. Primary gas burner 60 is substantially the same as the main burner disclosed and described in U.S. Pat. No. 4,883,043, the specification of which is hereby incorporated herein by reference. The heat from the flames issuing from primary gas burner 60, and the combustion products thereof, which are at a temperature above approximately 1470° F., cause at least portions of upper surface 51 of base plate 50, and the first and second front artificial log members 40 and 42 to glow visibly, thereby simulating the glow of burning logs and embers. In addition, the heat from the flames of primary gas burner 60 and the combustion by-products heats the log members and is, in turn, radiated outwardly to provide heat to the surroundings.

The gas-fired artificial log assembly of the present invention further includes neat gas burner means located between the rear artificial log 44 and the first and second front artificial log members 40 and 42, respectively. The neat gas burners 80 and 82, which are preferably disposed generally parallel to the front and rear logs, have downwardly-angled distal end portions 81 and 83, respectively, which angle downwardly at a location rearwardly adjacent to channel 52. Thus, the flame from the primary gas burner 60 which passes into and through channel 52 serves to ignite the neat gas burners 80 and 82 when they are supplied with gas.

Neat gas burners 80 and 82 are preferably provided with a plurality of gas orifices 86 such that the flames therefrom issue generally upwardly between rear log 44 and first and second front logs 40 and 42. Additionally, it is preferred that the flames issuing from neat gas burners 80 and 82 are peaked, as shown in FIG. 2, to further enhance the realism of the artificial log assembly. This can be accomplished by providing adjacent gas orifices 86 of progressively increasing diameter, to a maximum, and then progressively decreasing diameter, so as to control the height of the flames.

In all embodiments of the present invention, there is included a gas flow control (not shown) for controlling the gas supply to artificial log assembly 10. In a preferred embodiment of the invention, which includes first and second front artificial log members 40 and 42, rear artificial log 44, primary gas burner 60 and rear neat gas burners 80 and 82, the gas flow control is connected to a main gas supply (not shown), and has a control knob 102, the mechanism of which is housed in housing 100, preferably with five operational settings. In a first setting of control knob 102, the off position, no gas flows to the artificial log assembly 10 and it is non-operational. In a second setting, gas flows from the supply line through regulator 100 to a pilot (not shown), which is ignited in any suitable manner, for example, by an automatic spark igniter, or manually with a match. When control knob 102 is turned to the third setting, gas flows through regulator 100 to primary gas burner 60 and is ignited by the pilot (not shown but preferably located below the gas orifices of burner 60 to ensure ignition thereof). With control knob 102 in the fourth operational setting, gas flows to one of the rear neat gas burners 80 or 82, but not both, and that burner is positively ignited by the flame from primary gas burner 60 which passes through channel 52. When the control knob 102 is in the fifth setting, the full-on position, gas is supplied to the other rear neat gas burner 80 or 82, which is also lit by the flame from primary gas burner 60. In an alternative embodiment of the gas flow control, control knob 102 is provided with four settings: first, the off setting; second, the pilot setting as previously described; third, the primary burner on setting, previously described; and four, both rear neat gas burners on. With these types of control, variations in aesthetics and heat output from the fireplace assembly are possible by changing the setting to have more or less burners in operation at any given time.

Rear log 44, which is preferably supported at its distal ends by support members **36*a* and 36*b* (as shown in FIG. 1) is spaced above base plate 50 and support plate 28. In a preferred embodiment, rear log 44 includes an integral (although it need not be integrally attached) block 110 which rests on either upper surface 51 of base plate 50 or directly on support plate 28 (as shown in FIG. 3). Block 110 serves to prevent the flames from primary burner 60 which pass through channel 52 from issuing out the rear of the assembly. This enhances heat retention in the region defined by rear log 44 and first and second front logs 40 and 42, thereby increasing the combustion efficiency of neat gas burners 80 and 82. Block 110** may preferably be made of a refractory material which glows visibly when heated above about 1470° F. and therefore adds further realism to the assembly of the present invention by glowing visibly when heated by the flames of the primary burner.

There are several additional features which preferably may be included in assembly 10 of the present invention to add to the realism, as well as to increase the combustion efficiency thereof. Firstly, support structure 12 may include an elongated metal strip 120 secured to L-shaped grate members 34 extending along and in front of first and second front artificial log members 40 and 42 in a position generally vertically adjacent primary gas burner 60. Metal strip 120 serves to substantially prevent relatively "cold" air from the surroundings from entering combustion zone 70 and disrupting or decreasing the combustion therein. Strip 120 also serves to further define combustion zone 70 so that combustion therein runs at a higher temperature, and therefore more efficiently, which results in a decrease in the production of undesirable combustion by-products.

Secondly, a plurality of ember-simulating elements 130, which are preferably made of a refractory material that glows visibly above about 1470° F., may be located in and around channel 52 and are supported by the upper surface 51 of base plate 50 to further enhance the realism of the artificial log assembly of the present invention when heated to a visible glow by the primary burner flame. It is contemplated that the ember-simulating elements may form integral parts of either base plate 50, or the artificial logs, or both.

Next, an additional artificial log member 140 is supported by rear log 44 and second front artificial log 42 to provide the stacked appearance of logs in a real log fire. This additional log 140 is preferably positioned such that it does not substantially interfere with the flames issuing from rear neat gas burners 80 and 82, which issue upwardly on either side of log 140, as shown in FIG. 2.

Finally, particulate matter such as sand, volcanic stones or Vermiculite 142 may be placed on support surface 28 in a visible position in front of base plate 50 and generally below primary gas burner 60 (as shown in FIG. 3) to provide the appearance of ashes from a fire.

The scope of the present invention is defined by the appended claims and is not meant to be limited by the examples given herein.

We claim:

1. A gas-fired artificial log assembly for fireplaces and stoves comprising:

a support structure;

a base plate of a refractory material that glows visibly above about 1470° F., said base plate being supported by said support structure and having an upper surface;

at least one front artificial log member having first and second distal end sections and a medial section, said at least one front log member supported by said upper surface of said base plate, means defining a channel between said upper surface of said base plate and said at least one front leg member;

primary gas burner means supported by said support structure and extending along and in front of said at least one front log member and said channel and defining a combustion zone therebetween, said primary gas burner means for directing blue flame jets against said base plate, said at least one front log member and into said channel for heating to a visible glow at least portions of said base plate and said at least one front log member, whereby substantial heat is radiated to the surroundings and an appearance of glowing logs and underlying embers is provided to enhance the aesthetics of the artificial log fireplace;

a rear artificial log supported by said support structure and spaced from said at least one front log member; and neat gas burner means located between said rear artificial log and said at least one front log member for issuing flame jets generally upwardly to enhance the realism of the artificial log assembly;

whereby, the flame from said primary gas burner means which passes into said channel ignites said neat gas burner means and causes at least a portion of said rear artificial log to glow visibly.

2. A gas-fired artificial log assembly for fireplaces and stoves comprising:

a support structure;

a base plate of a refractory material that glows visibly above about 1470° F., said base plate being supported by said support structure and having an upper surface;

a first front artificial log member supported by said upper surface of said base plate;

a second front artificial log member having first and second distal end sections and a medial section, said first distal end section supported by said base plate and said second distal end section supported by said first front artificial log member, whereby a channel is defined by said upper surface of said base plate, said medial section of said second front artificial log member and said first front artificial log member;

primary gas burner means supported by said support structure and extending along and in front of said first and second front artificial log members and said channel and defining a combustion zone therebetween, said primary gas burner means for directing blue flame jets against said base plate, said first and second front artificial log members and into said channel for heating to a visible glow at least portions of said base plate and said first and second front artificial log members, whereby substantial heat is radiated to the surroundings and an appearance of glowing logs and underlying embers is provided to enhance the aesthetics of the artificial log fireplace;

a rear artificial log supported by said support structure and spaced from said first and second front artificial log members; and neat gas burner means located between said rear artificial log and said first and second front artificial log members for issuing flame jets generally upwardly to enhance the realism of the artificial log assembly;

whereby, the flame from said primary gas burner means which passes into said channel ignites said neat gas burner means and causes at least a portion of said rear artificial log to glow visibly.

3. The gas-fired artificial log assembly of claim 2 wherein said second front artificial log member has a truncated branch segment extending outwardly from said medial section thereof adjacent said channel to aid in trapping heat in said combustion zone and channeling the flame from said primary gas burner means into said channel.

4. The gas-fired artificial log assembly of claim 2 wherein said neat gas burner means comprises first and second burner tubes each having a downwardly angled distal end portion rearwardly adjacent said channel so as to aid in ignition of said burner tubes by the flame from said primary gas burner means which passes through said channel.

5. The gas-fired artificial log assembly of claim 2 wherein said neat gas burner means have a plurality of gas orifices therein of varying diameter such that the flames issuing therefrom are peaked to simulate the appearance of flames in a real solid fuel fire.

6. The gas-fired artificial log assembly of claim 2 wherein said support structure includes a support plate upon which said base plate is supported and a grate to support and retain said first and second front artificial log members.

7. The gas-fired artificial log assembly of claim 6 wherein said grate includes an elongated strip member extending along and in front of said first and second front artificial log members positioned generally vertically adjacent said primary gas burner means so as to further define said combustion zone between said primary gas burner means and said first and second front artificial log members.

8. The gas-fired artificial log assembly of claim 2 further comprising a plurality of ember-simulating members on said base plate in and around said channel to simulate the appearance of glowing embers when heated by the flame from said primary gas burner means.

9. A gas-fired artificial log assembly for fireplaces and stoves comprising:

a support structure;

a base plate of a refractory material that glows visibly above about 1470° F., said base plate being supported by said support structure and having an upper surface;

a front artificial log member supported by said upper surface of said base plate, said front artificial log member having first and second distal end sections and a medial section, said first and second distal end sections supported by said base plate, and said medial section having a cavity therein, whereby a channel is defined by said upper surface of said base plate and said cavity in said medial section of said front artificial log member;

primary gas burner means supported by said support structure and extending along and in front of said front artificial log member and said channel and defining a combustion zone therebetween, said primary gas burner means for directing blue flame jets against said base plate, said front artificial log member and into said channel for heating to a visible glow at least portions of said base plate and said front artificial log member, whereby substantial heat is radiated to the surroundings and an appearance of glowing logs and underlying embers is provided to enhance the aesthetics of the artificial log fire-place;

a rear artificial log supported by said support structure and spaced from said front artificial log member; and neat gas burner means located between said rear artificial log and said front artificial log member for issuing flame jets generally upwardly to enhance the realism of the artificial log assembly;

whereby, the flame from said primary gas burner means which passes into said channel ignites said neat gas burner means and causes at least a portion of said rear artificial log to glow visibly.

10. The gas-fired artificial log assembly of claim 8 wherein said plurality of ember-simulating members are made of a refractory material that glows visibly when heated above about 1470° F.

11. The gas-fired artificial log assembly of claim 9 wherein said front artificial log member has a truncated branch segment extending outwardly from said medial section thereof adjacent said channel to aid in trapping heat in said combustion zone and channeling the flame from said primary gas burner means into said channel.

12. The gas-fired artificial log assembly of claim 9 wherein said neat gas burner means comprises first and second burner tubes, each having a downwardly angles distal end portion rearwardly adjacent said channel so as to aid in ignition of said burner tubes by the flame from said primary gas burner means which passes through said channel.

13. The gas-fired artificial log assembly of claim 9 wherein said neat gas burner means have a plurality of gas orifices therein of varying diameter such that the flames issuing therefrom are peaked to simulate the appearance of flames in a real solid fuel fire.

14. The gas-fired artificial log assembly of claim 9 wherein said support structure includes a support plate upon which said base plate is supported and a grate to support and retain said front artificial log member.

15. The gas-fired artificial log assembly of claim 14 wherein said grate includes an elongated strip member extending along and in front of said front artificial log member positioned generally vertically adjacent said primary gas burner means so as to further defined said combustion zone between said primary gas burner means and said front artificial log member.

16. The gas-fired artificial log assembly of claim 9 further comprising a plurality of ember-simulating members on said base plate in and around said channel to simulate the appearance of glowing embers when heated by the flame from said primary gas burner means.

17. The gas-fired artificial log assembly of claim 16 wherein said plurality of ember-simulating members are made of a refractory material that glows visibly when heated above about 1470° F.

* * * * *